US009933169B2

(12) United States Patent
Mo et al.

(10) Patent No.: US 9,933,169 B2
(45) Date of Patent: Apr. 3, 2018

(54) COMPRESSOR

(71) Applicant: National Taiwan Normal University, Taipei (TW)

(72) Inventors: Huai-En Mo, New Taipei (TW); Tun-Ping Teng, New Taipei (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 0 days.

(21) Appl. No.: 15/093,890

(22) Filed: Apr. 8, 2016

(65) Prior Publication Data

US 2017/0159950 A1 Jun. 8, 2017

(30) Foreign Application Priority Data

Dec. 2, 2015 (TW) ..... 104140266 A

(51) Int. Cl.

| | |
|---|---|
| ***F24F 1/42*** | (2011.01) |
| ***F24F 1/36*** | (2011.01) |
| ***F24F 13/22*** | (2006.01) |
| ***F25D 21/14*** | (2006.01) |

(52) U.S. Cl.

CPC ..... *F24F 1/42* (2013.01); *F25D 21/14* (2013.01); *F24F 13/222* (2013.01); *F24F 2013/225* (2013.01); *F25D 2321/1411* (2013.01)

(58) Field of Classification Search

CPC .... F24F 1/42; F24F 13/222; F24F 1/36; F24F 2013/227; F24F 2013/225; F24F 13/082; F24F 1/02; F24F 1/50; F24F 1/38; F24F 1/46; F25D 2321/147; F25D 2321/803; F25D 14/13; F25D 21/14; F25D 2321/1411; F25D 2321/145; F25D 21/04; F25D 2321/141

USPC ..... 62/277

See application file for complete search history.

(56) References Cited

U.S. PATENT DOCUMENTS 3,225,563 A * 12/1965 Braun ..... F24F 13/224 62/277
3,825,372 A * 7/1974 Lundberg ..... F04C 29/026 417/321
5,399,073 A * 3/1995 Bauer ..... B01D 5/0072 261/104

(Continued)

FOREIGN PATENT DOCUMENTS

CN 100483044 C 4/2009
CN 202204127 U 4/2012

(Continued)

OTHER PUBLICATIONS

Taiwanese Search Report for Taiwanese Application No. 104140266, dated Jan. 25, 2018, with English translation.

*Primary Examiner* — Mohammad M Ali

(74) *Attorney, Agent, or Firm* — Birch, Stewart, Kolasch & Birch, LLP

(57) ABSTRACT

A compressor is to be used in an air conditioner. The air conditioner includes the compressor, an evaporator, and a container. The evaporator generates condensed water during operation. The container receives the condensed water generated by the evaporator. The compressor includes a main body and a textile member that is capable of transferring moisture and is quick drying. The main body is to be disposed in the container. The textile member covers at least a part of the main body, and is to be used for absorbing the condensed water.

12 Claims, 7 Drawing Sheets

(56) References Cited

U.S. PATENT DOCUMENTS

| | | | | |
|---|---|---|---|---|
| 5,881,566 | A * | 3/1999 | Shacklock | F25D 21/14 165/46 |
| 6,764,593 | B1 * | 7/2004 | Pace | B01D 46/0005 210/435 |
| 2006/0010897 | A1 * | 1/2006 | Huang | F24F 1/42 62/279 |
| 2006/0272346 | A1 * | 12/2006 | Huang | F24F 1/06 62/285 |
| 2007/0271941 | A1 * | 11/2007 | Ihle | F25B 40/04 62/277 |
| 2010/0166832 | A1 * | 7/2010 | Ingle | A47G 9/007 424/443 |

FOREIGN PATENT DOCUMENTS

| | | | |
|---|---|---|---|
| CN | 202250682 | U | 5/2012 |
| CN | 202853081 | U | 4/2013 |
| TW | M493013 | U | 1/2015 |

* cited by examiner

COMPRESSOR

CROSS-REFERENCE TO RELATED APPLICATION

This application claims priority of Taiwanese Patent Application No. 104140266, filed on Dec. 2, 2015.

FIELD

The disclosure relates to a compressor, more particularly to a compressor that is energy-efficient.

BACKGROUND

Due to the increasing demand for quality of life, air conditioners are becoming widely used in people's daily lives. With growing concerns over environmental issues, air conditioners with high energy efficiency ratios (EER) are highly appreciated. A conventional way of improving the energy efficiency ratio is to use a combination of an inverter compressor and a fan. However, for a fixed-frequency air conditioner, the inverter compressor and the fan must be additionally provided, resulting in increased manufacturing costs.

SUMMARY

Therefore, an object of the disclosure is to provide a compressor that can alleviate at least one of the drawbacks associated with the prior art.

According to an aspect of the disclosure, the compressor is to be used in an air conditioner. The air conditioner includes the compressor, an evaporator, and a container. The evaporator generates condensed water during operation. The container receives the condensed water generated by the evaporator. The air conditioning compressor includes a main body and a textile member that is capable of transferring moisture and is quick drying. The main body is to be disposed in the container. The textile member covers at least a part of the main body, and is to be used for absorbing the condensed water.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
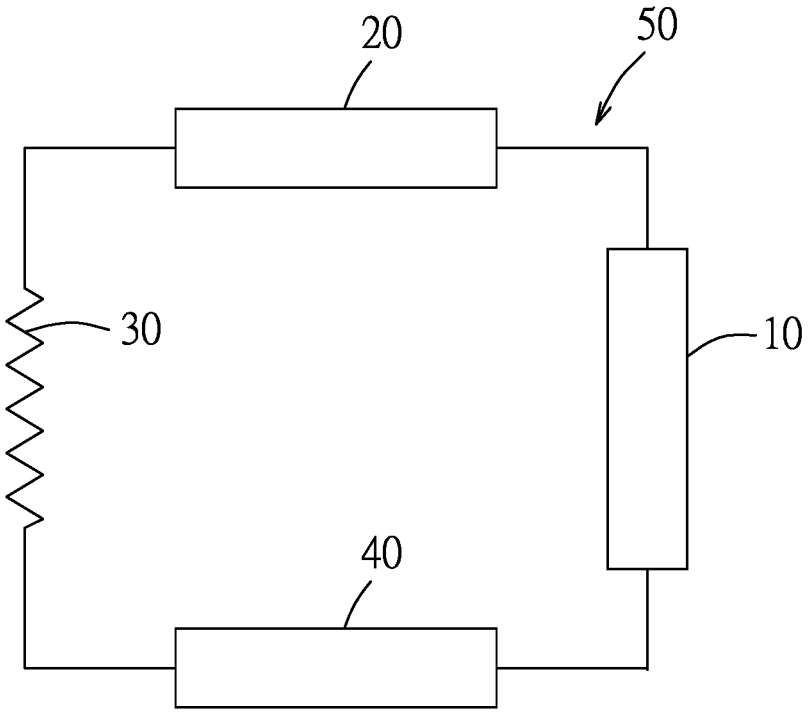
FIG. 1 is a block diagram showing an air conditioner that includes a compressor of this disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
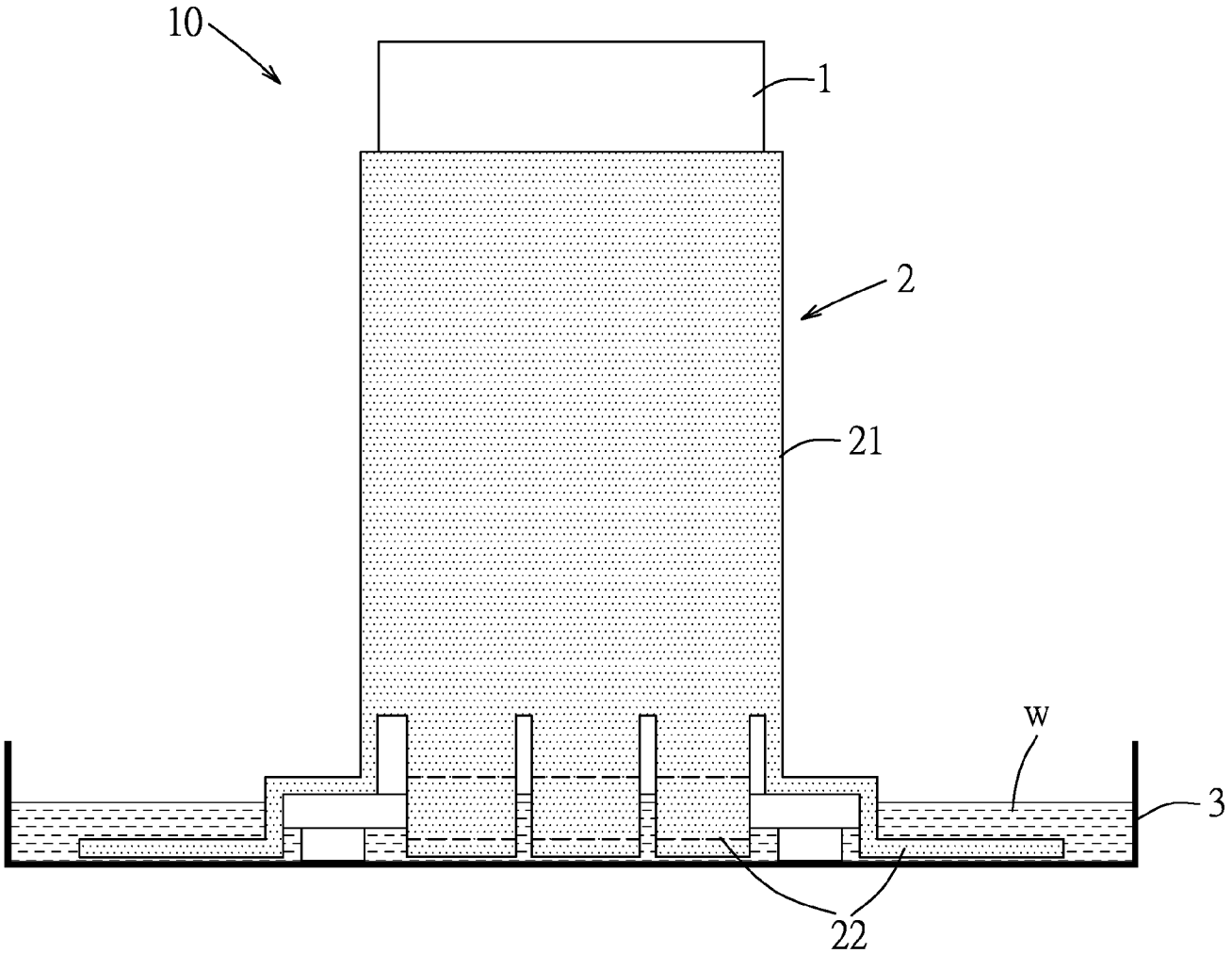
FIG. 2 is a schematic view showing a first embodiment of the compressor of this disclosure.
Figure 3:
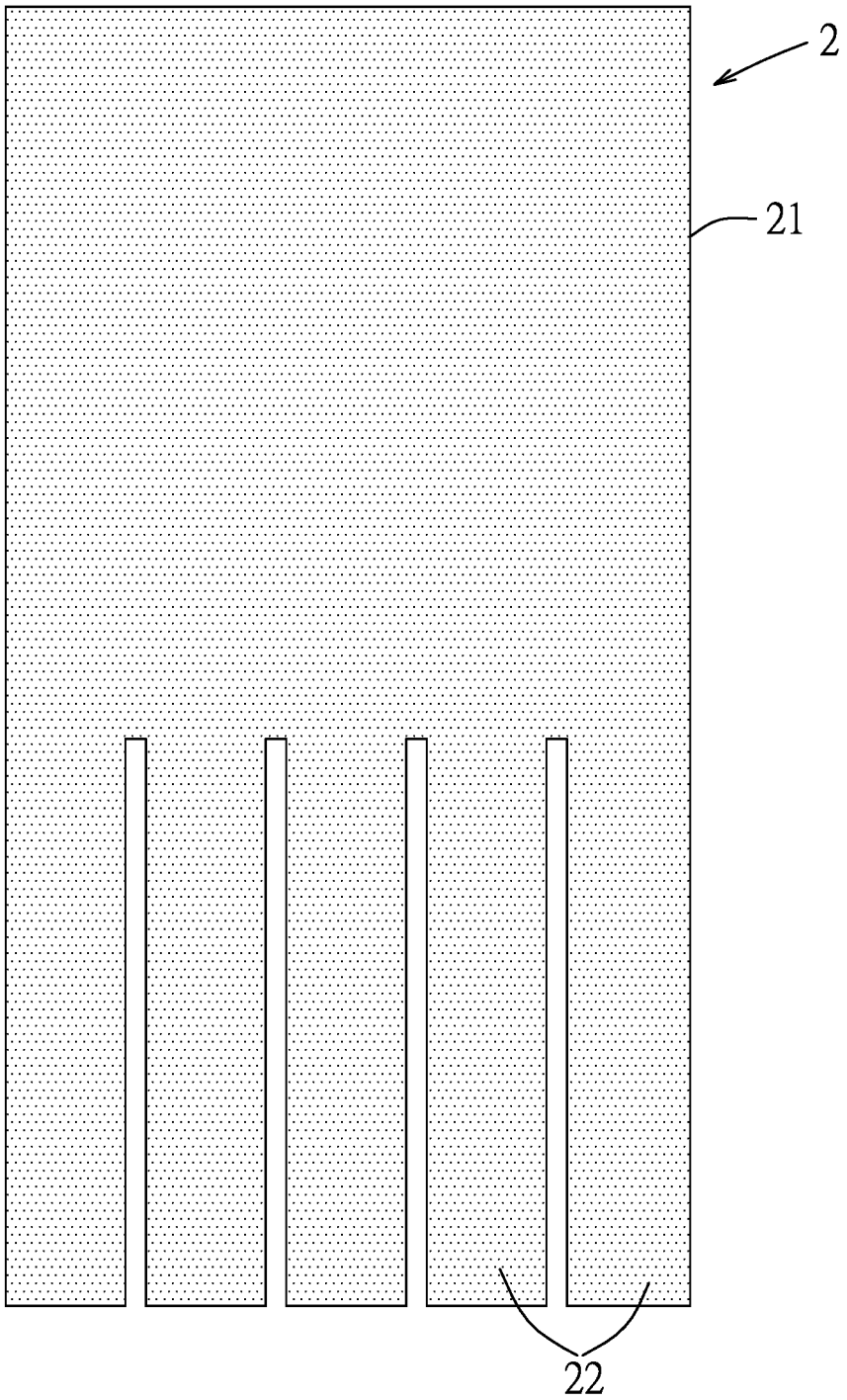
FIG. 3 is a schematic view showing a textile member of the first embodiment.

Referring to FIGS. 1 to 3, a first embodiment of a compressor 10 is to be used in an air conditioner. The air conditioner may be a window-type air conditioner, and includes the compressor 10, a condenser 20, a throttling valve 30, an evaporator 40, a fan (not shown), a refrigerant pipe 50, and a container 3. Moisture in the air is condensed into condensed water (w) by the evaporator 40 during operation. The refrigerant pipe 50 interconnects the evaporator 40, the condenser 20, the throttling valve 30, and the compressor 10. The container 3 holds the compressor 10, and receives the condensed water (w). The throttling valve 30 may be a capillary tube, an expansion valve, etc. The compressor 10 includes a main body 1 and a moisture transferring & quick drying textile member 2.

The main body 1 is to be disposed in the container 3. The textile member 2 covers at least a part of the main body 1, is to be used for absorbing the condensed water (w), and is attached to the main body 1 by means of sewing, buckling, hook-and-loop fastening, etc. In this embodiment, the textile member 2 is a strip textile that has multiple textile parts sewn together such that the textile member 2 is attached to the main body 1. It should be noted that the attaching mechanism of the moisture transferring & quick drying textile member 2 to the main body 1 should not be limited to those disclosed above, and may be changed according to practical requirements.

The textile member 2 has a covering section 21 that covers the at least a part of the main body 1, and at least one extending section 22 that extends from the covering section 21 and that is to be disposed in the container 3 for absorbing the condensed water (w) in the container 3. In certain embodiments, the number of the extending section 22 is more than one, with each extending section 22 extending into the container 3, thereby achieving improved water-absorbing efficiency.

The textile member 2 is made of a material selected from the group consisting of nylon, elastane, polyester, polypropylene, and combinations thereof. In certain embodiments, the textile member 2 is made of 64% nylon, 24% polyester, and 12% elastane. It should be noted that the composition of the textile member 2 should not be limited by what are disclosed herein, as long as the textile member 2 is capable of absorbing moisture and has rapid drying ability.

The rapid drying ability of the textile member 2 can be determined by measurement of a remained water ratio (RWR). To be more specific, the test conditions are set according to Chinese National Standards 5611 (CNS-5611), in which the textile member 2 is cut into a 5 cm×5 cm specimen, the temperature is controlled at 20±2° C., and the relative humidity is maintained at 65±2%. The dry weight ($w_f$) of the specimen is recorded, followed by using a micropipette to drip a 0.2 mL water droplet at 1 cm above the center of the specimen, and recording the wet weight ($w_0$) of the specimen. The weight of the specimen ($w_i$) is recorded at a 1-minute interval (alternatively, a 10-minute interval) continuously for an overall testing time of 100 minutes. The $40^{th}$ minute specimen weight is chosen as the assessment index for this test. The $40^{th}$ minute RWR (%) is calculated by $[(w_i-w_f)/(w_o-w_f)]\times100\%$. The textile member 2 has a remained water ratio not greater than 35% In certain embodiments, the textile member 2 has a remained water ratio not greater than 13%.

Figure 4:
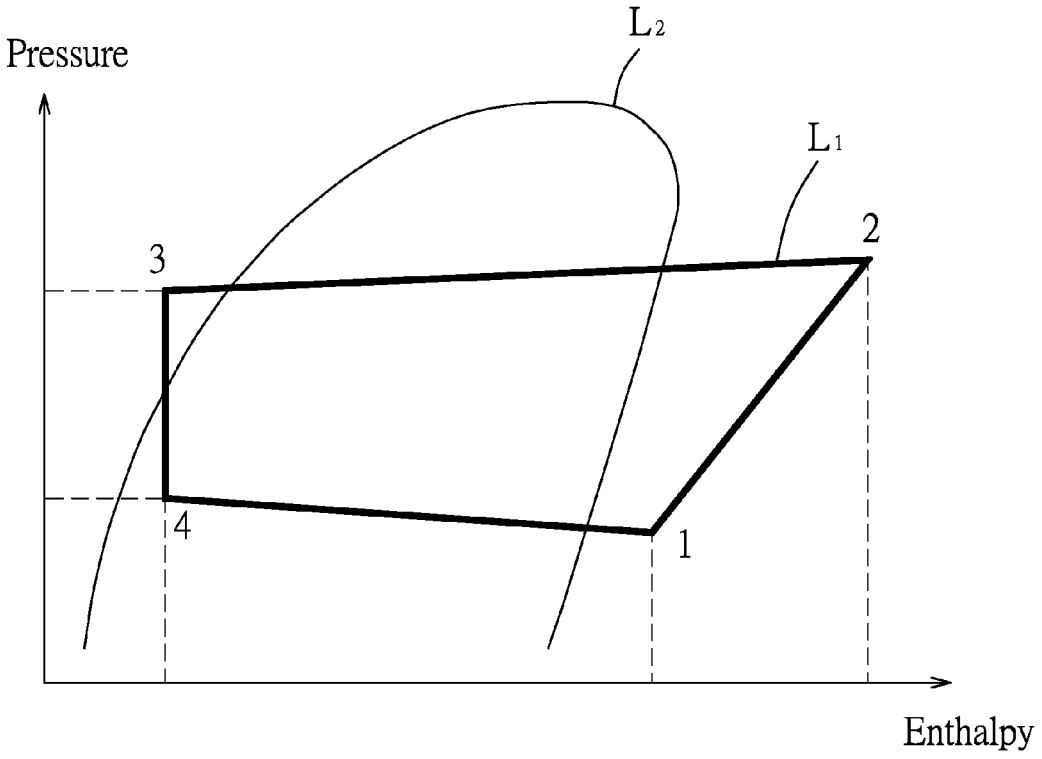
FIG. 4 is a pressure-enthalpy diagram of a refrigerant during operation in the air conditioner.

FIG. 4 is a pressure-enthalpy diagram of a refrigerant during operation in the air conditioner. $L_1$ denotes a refrigeration cycle. $L_2$ is a saturation curve. In an ideal vapor refrigeration cycle, the refrigerant enters the compressor 10 at point 1 as a saturated vapor and leaves the compressor 10 at point 2 as a superheated vapor; this process is termed adiabatic compression. Then, the refrigerant enters the condenser 20 as the superheated vapor at point 2 and leaves the condenser 20 as a saturated liquid at point 3, which is an isobaric heat rejection process. Afterwards, the refrigerant passes through the throttling valve 30, undergoes adiabatic expansion at constant enthalpy, and reaches point 4 as a saturated liquid-vapor mixture. Finally, the refrigerant enters the evaporator 40, undergoes isobaric evaporation, and returns to point 1 as the saturated vapor. In an actual refrigeration cycle, the refrigerant may not be completely evaporated in the evaporator 40, and liquid compression may happen in the compressor 10, which may reduce the lifetime of the compressor 10. Therefore, the refrigerant is superheated at point 1 to ensure safety of the compressor 10. The actual compression process (point 1-2) involves frictional effect, which increases the entropy. In the point 2-3 process (the actual condensed process) and the point 4-1 process (the actual evaporated process), refrigerant friction causes pressure drop. The refrigerant is subcooled somewhat before it enters the throttling valve 30. The point 3-4 is an adiabatic and isenthalpic process. The refrigerant is evaporated in the evaporator 40, the heat exchange between the evaporator 40 and ambient air leads to the generation of the condensed water (w). The condensed water (w) is received in the container 3.

The condensed water (w) in the container 3 is absorbed by the extending section 22 of the textile member 2, and then permeated to the covering section 21. Through the heat exchange, including sensible heat and latent heat, between the main body 1 and the condensed water (w), the temperature of the main body 1 and the refrigerant in the main body 1 can be decreased.

Efficiency of the air conditioner can be measured by the coefficient of performance (COP), which is proportional to the energy efficiency ratio (EER). The coefficient of performance of the air conditioner is defined by $(h_1-h_4)/(h_2-h_1)$, in which $h_1$, $h_2$, $h_3$, and $h_4$ are respectively the enthalpy values of the refrigerant at points 1, 2, 3, and 4. In the compression process (point 1-2), the reduction of the temperature of the refrigerant in the main body 1 results in entropy reduction, and shifts point 2 toward the left in FIG. 4, meaning that the value of $h_2$ is reduced, resulting in an increased COP value.

Figure 5:
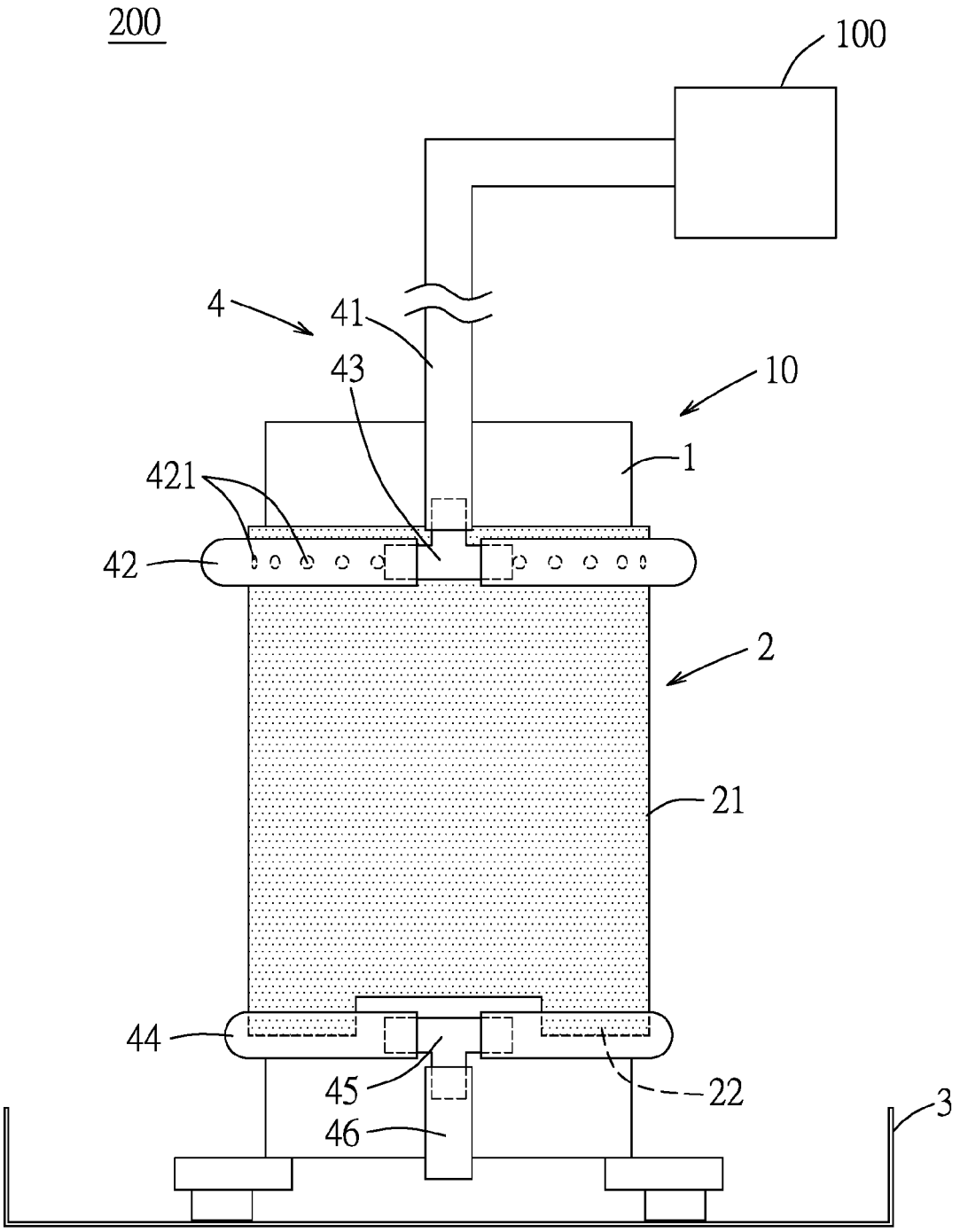
FIG. 5 is a fragmentary schematic view of a second embodiment of the compressor of this disclosure.

Referring to FIGS. 1 and 5, a second embodiment of the compressor 10 is similar to the first embodiment, with differences disclosed hereinafter. The second embodiment is used in a split-type air conditioner which includes an indoor unit 100, an outdoor unit 200, and the refrigerant pipe 50. The indoor unit 100 includes the evaporator 40. The outdoor unit 200 includes the compressor 10, the condenser 20, the throttling valve 30, and the container 3. The compressor 10 includes the main body 1, the textile member 2, and a water-collecting unit 4.

Figure 6:
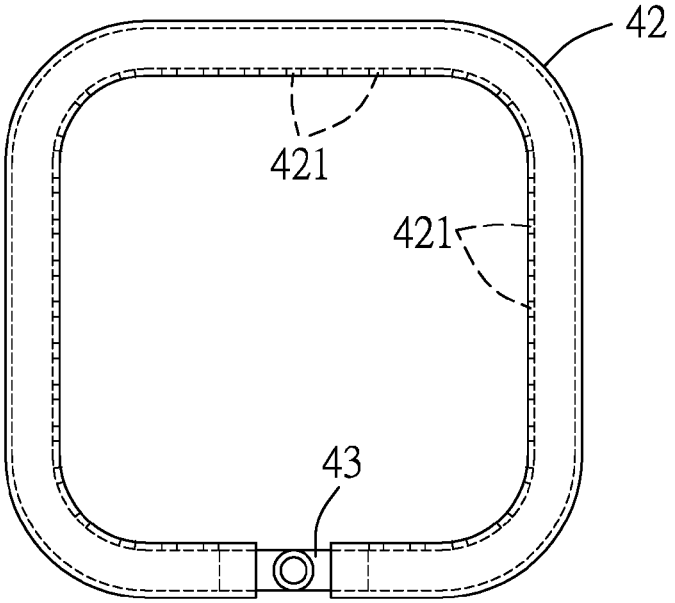
FIG. 6 is a top view of a first water-collecting element and a first connector of a water-collecting unit included in the second embodiment.
Figure 7:
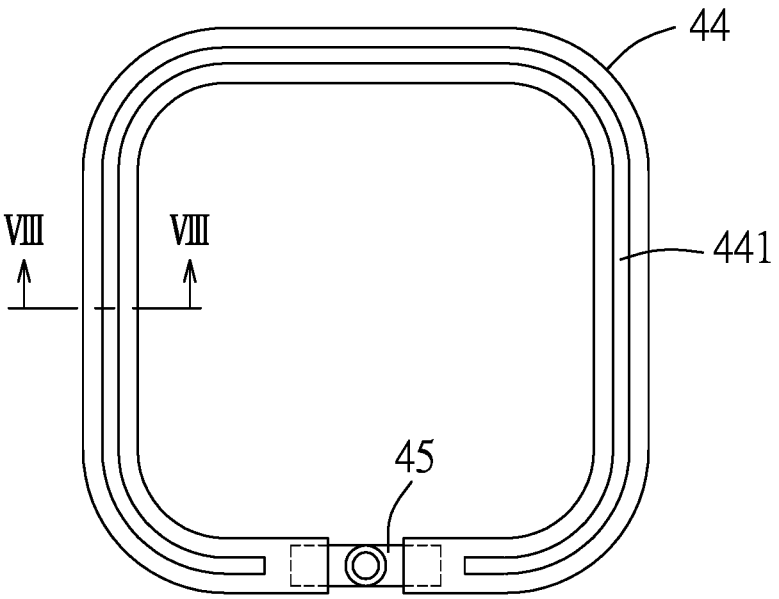
FIG. 7 is a top view of a second water-collecting element and a second connector of the water-collecting unit included in the second embodiment.
Figure 8:
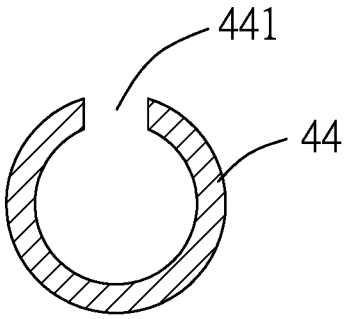
FIG. 8 is a cross-sectional view of the second water-collecting element taken along line VIII-VIII of FIG. 7.

Referring further to FIGS. 6 to 8, the water-collecting unit 4 is disposed on the main body 1, and is to be used for collecting the condensed water (w) and discharging the condensed water (w) to the textile member 2. The water-collecting unit 4 includes a first drainpipe 41, a first water-collecting element 42, a first connector 43, a second water-collecting element 44, a second connector 45, and a second drainpipe 46. The first drainpipe 41 is connected with the evaporator 40 of the indoor unit 100. The first connector 43 interconnects the first drainpipe 41 and the first water-collecting element 42. The first water-collecting element 42 is in the form of a hollow tube, surrounds the textile member 2, and is formed with a plurality of discharging holes 421 facing the textile member 2. The condensed water (w) generated by the evaporator 40 is flumed through the first drainpipe 41 and the first connector 43 to the first water-collecting element 42, and is discharged from the first water-collecting element 42 to the covering section 21 of the textile member 2 through the discharging holes 421.

The second water-collecting element 44 is disposed below the first water-collecting element 42, is in the form of a hollow tube, and is formed with an open groove 441. The second connector 45 interconnects the second water-collecting element 44 and the second drainpipe 46. The textile member 2 enters the second water-collecting element 44 through the open groove 441 in such a manner that the condensed water (w) flowing through but not absorbed by the textile member 2 is capable of being collected in the second water-collecting element 44 and flowing into the container 3 through the second connector 45 and the discharging pipe 46. In this embodiment, the extending section 22 of the textile member 2 enters the water-collecting element 44 through the open groove 441.

The first embodiment of this disclosure utilizes the textile member 2 to absorb the condensed water (w) and cool the main body 1. The second embodiment utilizes the water-collecting unit 4 to drain the condensed water (w) to the textile member 2, thereby also achieving the purpose of cooling the main body 1.

To sum up, the textile member 2 is capable of absorbing the condensed water (w) to cool the main body 1 of the compressor 10 via sensible heat transfer. With the rapid drying property of the textile member 2, the cooling efficiency of the main body 1 can be further increased via latent heat transfer during evaporation of the condensed water (w). Therefore, the temperature of the main body 1 and the temperature of the refrigerant in the main body 1 can be decreased, thereby increasing the coefficient of performance and the energy efficiency ratio of the air conditioner. Furthermore, the textile member 2 can be easily installed to or detached from the main body 1, and therefore the compressor 10 of this disclosure is easy to manufacture and cost-efficient for maintenance.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A compressor adapted to be used in an air conditioner, the air conditioner including said compressor, an evaporator, and a container, the evaporator generating condensed water during operation, the container receiving the condensed water generated by the evaporator, said compressor comprising:

a main body that is to be disposed in the container; and a textile member that is capable of transferring moisture and is quick drying, said textile member covering at least a part of said main body, and being adapted for absorbing the condensed water, wherein said textile member has a remained water ratio not greater than 35% determined according to Chinese National Standards-5611 (CNS-5611) at the $40^{th}$ minutes, and wherein said textile member is made of a material selected from the group consisting of nylon, elastane, polyester, polypropylene, and combinations thereof.

2. The compressor as claimed in claim 1, wherein said textile member has a covering section that covers said at least a part of said main body, and at least one extending section that extends from said covering section and that is to be disposed in the container for absorbing the condensed water in the container.

3. The compressor as claimed in claim 1, further comprising a water-collecting unit that is disposed on said main body, and that is adapted to collect the condensed water and to discharge the condensed water to said textile member.

4. The compressor as claimed in claim 3, wherein said water-collecting unit includes a first drainpipe for being connected with the evaporator, a first water-collecting element, and a first connector interconnecting said first drainpipe and said first water-collecting element, said first water-collecting element being in the form of a hollow tube, surrounding said textile member, and being formed with a plurality of discharging holes facing said textile member, the condensed water generated by the evaporator being drained through said first drainpipe and said first connector to said first water-collecting element, and being discharged from said first water-collecting element to the textile member through said discharging holes.

5. The compressor as claimed in claim 4, wherein said water-collecting unit further includes a second water-collecting element, a second drainpipe, and a second connector interconnecting said second water-collecting element and said second drainpipe, said second water-collecting element being disposed below said first water-collecting element, being in the form of a hollow tube, and being formed with an open groove, said textile member entering said second water-collecting element through said open groove in such a manner that the condensed water flowing through but not absorbed by the textile member is capable of being collected in said second water-collecting element and flowing into the container through said second connector and said second drainpipe.

6. The compressor as claimed in claim 5, wherein said textile member has a covering section that covers said at least a part of said main body, and at least one extending section that enters said water-collecting element through said open groove.

7. A compressor adapted to be used in an air conditioner, the air conditioner including said compressor, an evaporator, and a container, the evaporator generating condensed water during operation, the container receiving the condensed water generated by the evaporator, said compressor comprising:

a main body that is to be disposed in the container;

a textile member that is capable of transferring moisture and is quick drying, said textile member covering at least a part of said main body, and being adapted for absorbing the condensed water; and a water-collecting unit that is disposed on said main body, and that is adapted to collect the condensed water and to discharge the condensed water to said textile member, wherein said water-collecting unit includes a first drainpipe for being connected with the evaporator, a first water-collecting element, and a first connector interconnecting said first drainpipe and said first water-collecting element, said first water-collecting element being in the form of a hollow tube, surrounding said textile member, and being formed with a plurality of discharging holes facing said textile member, the condensed water generated by the evaporator being drained through said first drainpipe and said first connector to said first water-collecting element, and being discharged from said first water-collecting element to the textile member through said discharging holes.

8. The compressor as claimed in claim 7, wherein said textile member has a remained water ratio not greater than 35% determined according to Chinese National Standards-5611 (CNS-5611) at the $40^{th}$ minutes.

9. The compressor as claimed in claim 7, wherein said textile member is made of a material selected from the group consisting of nylon, elastane, polyester, polypropylene, and combinations thereof.

10. The compressor as claimed in claim 7, wherein said textile member has a covering section that covers said at least a part of said main body, and at least one extending section that extends from said covering section and that is to be disposed in the container for absorbing the condensed water in the container.

11. The compressor as claimed in claim 7, wherein said water-collecting unit further includes a second water-collecting element, a second drainpipe, and a second connector interconnecting said second water-collecting element and said second drainpipe, said second water-collecting element being disposed below said first water-collecting element, being in the form of a hollow tube, and being formed with an open groove, said textile member entering said second water-collecting element through said open groove in such a manner that the condensed water flowing through but not absorbed by the textile member is capable of being collected in said second water-collecting element and flowing into the container through said second connector and said second drainpipe.

12. The compressor as claimed in claim 11, wherein said textile member has a covering section that covers said at least a part of said main body, and at least one extending section that enters said water-collecting element through said open groove.

* * * * *